US012721462B2

(12) United States Patent
Hansen

(10) Patent No.: US 12,721,462 B2
(45) Date of Patent: Sep. 1, 2026

(54) METHOD FOR DRESSING HOSIERY ON A PERSON

(71) Applicant: DAN-REHAB A/S, Tørring (DK)

(72) Inventor: Jacob Falck Hansen, Skanderborg (DK)

(73) Assignee: DAN-REHAB A/S, Tørring (DK)

( * ) Notice: Subject to any disclaimer, the term of this patent is extended or adjusted under 35 U.S.C. 154(b) by 0 days.

(21) Appl. No.: 19/135,749

(22) PCT Filed: Dec. 4, 2023

(86) PCT No.: PCT/EP2023/084048
§ 371 (c)(1),
(2) Date: Jun. 4, 2025

(87) PCT Pub. No.: WO2024/121020
PCT Pub. Date: Jun. 13, 2024

(65) Prior Publication Data

US 2026/0206991 A1 Jul. 23, 2026

(30) Foreign Application Priority Data

Dec. 5, 2022 (EP) ..... 22211302

(51) Int. Cl.
*A47G 25/90* (2006.01)

(52) U.S. Cl.
CPC ..... *A47G 25/905* (2013.01)

(58) Field of Classification Search
CPC ..... A47G 25/905; A61H 2015/0007; A61H 2015/0014
See application file for complete search history.

(56) References Cited

U.S. PATENT DOCUMENTS 2,903,170 A * 9/1959 Ahn ..... A47G 25/905 223/111
4,834,073 A * 5/1989 Bledsoe ..... A61H 1/0259 601/34

(Continued)

FOREIGN PATENT DOCUMENTS

| | | |
|---|---|---|
| EP | 3874995 | 9/2021 |
| KR | 20120122613 | 11/2012 |
| WO | WO9935942 | 7/1999 |

OTHER PUBLICATIONS

European Search Report for corresponding European Application No. EP 22 21 1302 dated Apr. 21, 2023, 3 pages.

(Continued)

*Primary Examiner* — Shaun R Hurley
(74) *Attorney, Agent, or Firm* — Lee & Hayes, P.C.

(57) ABSTRACT

A method for dressing hosiery on a person with reduced mobility. The method includes: placing the person with reduced mobility in a supine position on an underlying surface, elevating the knee of a leg of the person, sliding a roller support in under the elevated knee so that a first free-rolling roller of the roller support is placed substantially under the elevated knee and so that a second free-rolling roller of the roller support is placed substantially under the calf of the leg. The first free-rolling roller and the second free-rolling roller are interconnected through a base of the roller support. The base has a support face resting on the underlying surface.

13 Claims, 2 Drawing Sheets

(56) References Cited

U.S. PATENT DOCUMENTS

| | | | | |
|---|---|---|---|---|
| 5,211,161 | A * | 5/1993 | Stef | A61H 1/0266 601/5 |
| 6,102,262 | A * | 8/2000 | Nicholson | A47G 25/905 223/111 |
| 8,356,735 | B1 * | 1/2013 | Drakeford | A47G 25/905 223/112 |
| 8,474,666 | B2 * | 7/2013 | Vitillo | A47G 25/80 223/113 |
| 8,696,606 | B2 * | 4/2014 | Jacofsky | A61H 1/008 601/122 |
| 11,116,690 | B1 | 9/2021 | Corcoran | |
| 2009/0120975 | A1 * | 5/2009 | Schoepe | A47G 25/905 223/111 |
| 2010/0063429 | A1 * | 3/2010 | McClorey | A61H 15/00 601/122 |
| 2017/0095698 | A1 | 4/2017 | Piumatti | |
| 2020/0337920 | A1 * | 10/2020 | Hansen | A61G 5/1067 |
| 2022/0133511 | A1 * | 5/2022 | Stevenson | A61F 2/7812 623/36 |
| 2022/0304881 | A1 * | 9/2022 | Choi | A61H 1/0274 |

OTHER PUBLICATIONS

PCT Search Report for corresponding PCT Application No. PCT/EP2023/084048 dated Feb. 21, 2024, 4 pages.

* cited by examiner

METHOD FOR DRESSING HOSIERY ON A PERSON

This application claims priority to PCT Application No. PCT/EP2023/084048, filed Dec. 4, 2023, which claims priority to EP patent application Ser. No. 22/211,302.9, filed Dec. 5, 2022, the contents of each of which is incorporated herein by reference.

FIELD OF THE INVENTION

The invention relates to a method for dressing hosiery on a person with reduced mobility and to use of a method for aiding health care personnel in dressing compression stockings on a person with reduced mobility.

BACKGROUND OF THE INVENTION

It often happens that sick people, old people, disabled people or other people that in some ways are physically impeded needs aid from health care personnel or others to do daily tasks such as putting on compression stockings or other types of hosiery.

Thus, from the European patent application EP 3 874 995 A1 it is known to place a person with reduced mobility in a tiltable chair with a tiltable leg rest comprising rollers supporting both legs of the person, so that hosiery may be slid onto the legs of the person. However, this method is complicated in that it requires as specific chair and it need the person to be placed in this specific chair. Furthermore, from the international patent application WO 99/35942 A1 a device comprising two inverted U-shaped parts formed integrally with a base so that a guide groove is formed which a user's foot can slide down to push a previously placed sock or support stocking on the user's foot. However, this device demands much mobility of the user, and is troublesome to operate even by the aid of health care personnel or other.

If a bedbound person with reduced mobility e.g., needs to be dressed in compression stockings while in bed or before getting out of bed, a health care person or other will have to lift the leg of the bedbound person while fitting the compression stocking on the leg and this is either burdening for the health care person and/or requires two health care persons.

It is therefore an object of the present invention to address these problems.

SUMMARY OF THE INVENTION

Disclosed is a method for dressing hosiery on a person with reduced mobility. The method comprises the steps of:

- placing the person with reduced mobility in a supine position on an underlying surface,
- elevating the knee of a leg of the person,
- sliding a roller support in under the elevated knee so that a first free-rolling roller of the roller support is placed substantially under the elevated knee and so that a second free-rolling roller of the roller support is placed substantially under the calf of the leg, wherein the first free-rolling roller and the second free-rolling roller are interconnected through a base of the roller support, wherein the base comprises a support face resting on the underlying surface,
- lowering the knee until the leg rests on the first free-rolling roller and the second free-rolling roller, and
- sliding or rolling the hosiery onto the leg so that at least a part of the hosiery slides or rolls between the leg and at least the second free-rolling roller.

It is advantageous to aid in dressing hosiery on a person with reduced mobility according to the above-described method in that the person helping may easier dress the hosiery onto the person with reduced mobility. More specifically, the person helping is less strained because the person may simply slide the hosiery onto a leg of the person placed in supine position while the leg is supported by the roller support in that the hosiery can easily be slid past the free-rolling roller supporting the leg.

Furthermore, since the rollers are free rolling, any unpleasant friction between the skin of the leg and the rollers is avoided if the roller support is displaced lengthwise so that it is more comfortable for the user when being dressed.

The term "hosiery" should be understood as any kind of compression stockings, trousers, socks, leggings or other type of legwear.

Furthermore, it should be noted that any reference to orientation throughout this document is made in relation to the roller support during normal intended use where the support face is resting against the typically horizontal underlying surface so that the rollers are extending upwards and in the opposite direction of the support face.

In an embodiment, the method further comprises the step of elevating the knee again after sliding or rolling the hosiery onto the leg and removing the roller support.

It is advantageous to elevate the knee while removing the roller support in that hereby any unpleasant friction between the leg and the rollers avoided in the removing process.

In an embodiment, the knee of the leg of the person is elevated until the knee angle between the thigh and the lower leg of the leg is at least 60°, preferably at least 70°, and most preferred at least 80°.

If the leg is bend too much it could be unpleasant for the person, and it might be difficult to fit the roller support between the buttocks and the foot of the person. However, if the leg is bend too little it will become difficult or impossible to slide the roller support in under the leg. Thus, the present angle limitations are advantageous in relation to comfort and functionality.

In an embodiment, the knee is lowered until the knee rests on the first free-rolling roller and the calf rests on the second free-rolling roller.

Lowering the knee so that the knee rests on the first free-rolling roller and the calf rests on the second free-rolling roller is advantageous in that this will elevate the foot to make it easier to fit the hosiery and in that the free-rolling roller placed in the back of the bend knee will aid in locking the roller support against displacement in the lengthwise direction of the person being dressed.

In an embodiment, the hosiery is a compression stocking.

Regarding compression stockings it is often important that these are fitted on the user before the user gets out of bed and in some cases people that are to ill or other to be moved from the bed still need compression stocking. Thus, the present method is particularly advantageous for dressing compression stocking on a person.

In an embodiment, the first free-rolling roller rotates around a first rotation axis and the second free-rolling roller rotates around a second rotation axis, and wherein the method further comprises sliding the roller support in under the elevated knee so that the first rotation axis and the second rotation axis are transverse in relation to a longitudinal direction of the leg.

Arranging the rotational axes of the roller perpendicular to the longitudinal direction of the leg and the person is advantageous in that this will ensure a more smooth and friction-free process when sliding or rolling the hosiery past the rollers.

In an embodiment, the method further comprises forming the roller support so that the first free-rolling roller rotates around a first rotation axis and the second free-rolling roller rotates around a second rotation axis.

It is advantageous if the free-rolling rollers rotate around their respective rotation axis in that they may rotate independently of each other.

In an embodiment, the method further comprises forming the roller support so that the first and/or the second free-rolling roller is padded.

It is advantageous if the free-rolling rollers are padded/stuffed in that a soft support is provided to the legs of the user with reduced mobility.

In an embodiment, the method further comprises forming the roller support so that the support face is substantially flat and extending past both the first free-rolling roller and the second free-rolling roller before sliding the roller support in under the elevated knee.

Forming the support face flat and extending beyond the rollers ensures that it is more stable and stays positioned correctly when placed on the underlying surface and being affected by the load of the leg.

In an embodiment, the first free-rolling roller rotates around a first rotation axis and the second free-rolling roller rotates around a second rotation axis, and wherein the method further comprises forming the roller support so that the first rotation axis is extending further from the support face than the second rotation axis.

Forming the roller support so that the first free-rolling roller is higher than the second free-rolling roller when the support face of the roller support is placed on a horizontal surface is advantageous in that the first free-rolling roller hereby will be urged towards and maintained in the back of the knee while the lower second free-rolling roller will maintain the leg elevated and bend in a comfortable angle which at the same time makes it easier for an assisting person to dress the hosiery on the leg.

In an embodiment, the method further comprises forming the roller support so that the first free-rolling roller and the second free-rolling roller are substantially parallel.

Forming the roller parallel is advantageous in that the hereby both can be arranged to roll in the lengthwise directed on the leg resting on the rollers.

In an embodiment, the method further comprises forming the roller support so that the first free-rolling roller and the second free-rolling roller are substantially parallel, and wherein an axial extend the first free-rolling roller and the second free-rolling roller is substantially perpendicular to the direction in which the parallel first free-rolling roller and the second free-rolling roller are displaced from each other.

Displacing the rollers so that they are arranged in continuation of each other with the rotational axes parallel and displaced in a direction perpendicular to the rotational axes is advantageous in that the rollers hereby are spaced apart along the length of the leg with the rotational axes perpendicular to the length of the leg hereby ensuring that the free-rolling rollers may roll freely in the lengthwise direction of the leg and thus ensure that the hosiery may more easily pass between the rollers and the leg.

In an embodiment, the method further comprises forming the roller support so that the first free-rolling roller rotates around a first rotation axis and the second free-rolling roller rotates around a second rotation axis, and wherein the first rotation axis and the second rotation axis are displaced between 50 and 500 mm, preferably between 100 and 400 mm and most preferred between 150 and 320 mm.

If the distance between the rollers is too big, a short leg may not be supported properly by both rollers and/or the second free-rolling roller may be located at the foot making it difficult to get the hosiery on. However, if the distance between the rollers is too short the pressure between the second free-rolling roller and the leg may become so high that it causes discomfort and makes it more difficult to slide the hosiery between the roller and the leg. Thus, the present displacement ranges present an advantageous relationship between functionality and comfort.

In an embodiment, the method further comprises forming the roller support so that the outer diameter of the first free-rolling roller and/or the second free-rolling roller is between 20 and 300 mm, preferably between 50 and 200 mm and most preferred between 70 and 150 mm.

If the diameter of the rollers is too big the total height of the roller support becomes too high making it less comfortable for the user and making it difficult to fit the roller support in under the leg. However, if the diameter of the rollers is too little the pressure between the rollers and the leg becomes so high that it causes discomfort and it makes it more difficult to pass the hosiery between the roller and the leg. Thus, the present displacement ranges present an advantageous relationship between functionality and comfort.

In an embodiment, the method further comprises forming the roller support so that the first free-rolling roller and the second free-rolling roller are substantially identical.

Forming the first free-rolling roller and the second free-rolling roller substantially identical is advantageous in that this simplifies manufacturing and assembly of the roller support.

In an aspect the method is performed by means of a roller support for aiding in dressing hosiery on a person with reduced mobility, the roller support comprising a first free-rolling roller, a second free-rolling roller, and a base arranged to interconnect the first free-rolling roller and the second free-rolling roller, and wherein the base comprises a support face arranged to form a support for the first free-rolling roller and the second free-rolling roller.

Forming a roller support by interconnecting a first free-rolling roller and a second free-rolling roller through a base ensures a simple and efficient design in which the rollers and the support face are maintained in the right mutual position while providing s solid base for the roller support to rest on.

In an embodiment, the first free-rolling roller rotates around a first rotation axis and the second free-rolling roller rotates around a second rotation axis, wherein the first rotation axis is arranged at a first roller distance of between 30 and 300 mm, preferably between 60 and 220 mm, and most preferred between 90 and 180 mm from the support face and wherein the second rotation axis is arranged in a second roller distance between 5 and 60%, preferably between 10 and 50%, and most preferred between 18 and 40% closer to the support face than the first rotation axis.

If the first rotation axis is arranged too high, the roller support becomes too high making it less comfortable for the user and making it more difficult to place the roller support under the leg. However, if the first rotation axis is arranged too low, the diameter of the rollers has to be little to make the roller roll freely and if the diameter of the rollers is too little, the pressure between the rollers and the leg becomes so high that it causes discomfort and it makes it more difficult to pass the hosiery between the roller and the leg.

Furthermore, if the height difference between the first and the second free-rolling roller is too big the foot of the leg may rest on the underlying surface making it difficult to dress the hosiery and it the height difference between the first and the second free-rolling roller is too little it becomes more difficult to maintain the roller support in its correct position (in that the first free-rolling roller is not sufficiently locked in the back of the knee). Thus, the present height ranges present an advantageous relationship between functionality and comfort.

Even further the invention provides for use of a roller support according to any of the previously discussed roller supports for aiding health care personnel in dressing compression stockings on a person with reduced mobility.

Compression stockings are usually relatively troublesome to dress on a person with reduced mobility due to the compressive fabric. In order to do so, a health care person must usually lift the entire leg so that the compressive stocking may be dressed onto the leg. Obviously, this is very strenuous, hard work and therefore inherently time consuming. Thus, it is advantageous if a method according to any of the previously described methods is used to dress compressions stockings on a person with reduced mobility in that the strain on the health care personnel is reduced, the dressing/undressing process is more comfortable for the person with reduced mobility and the dressing/undressing process is more time efficient.

For a more complete understanding of the disclosure, reference is now made to the following brief description of various combinable embodiments of the invention.

FIGURES

Figure 5:
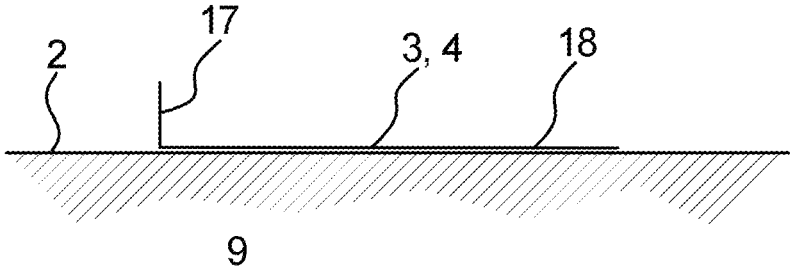
Figure 6:
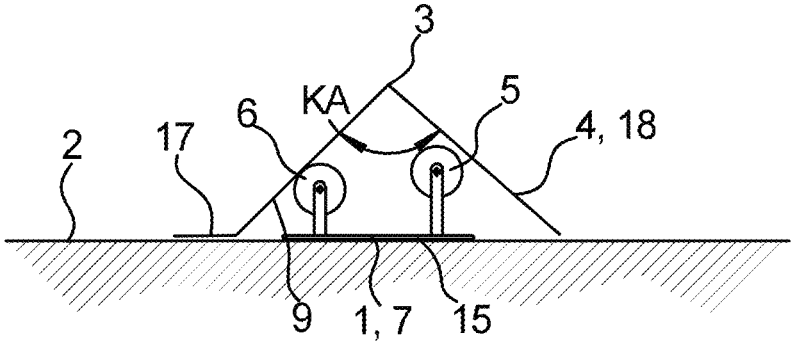
Figure 7:
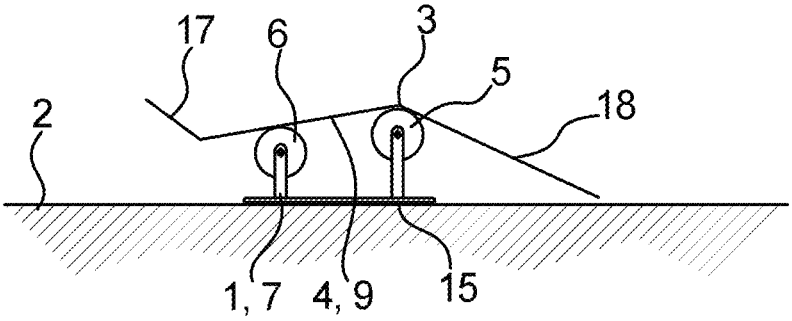
Figure 8:
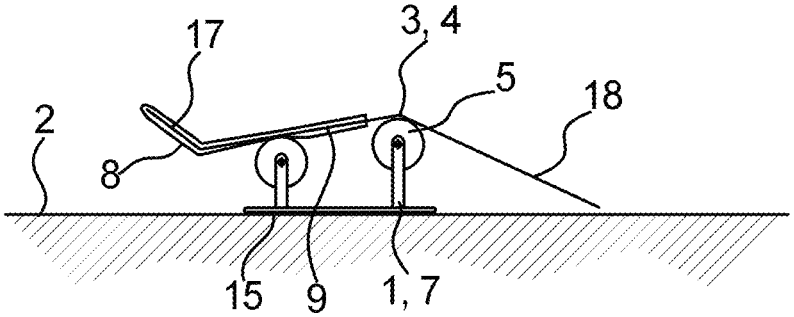
Figure 9:
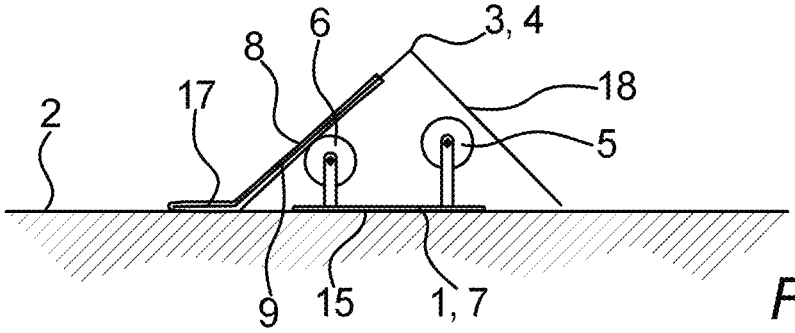

FIG. 5 illustrates a simplified representation of the lower part of a person laying on an underlying surface, as seen from the side, FIG. 6 illustrates a roller support being placed under a leg, as seen from the side, FIG. 7 illustrates a leg resting on a roller support, as seen from the side, FIG. 8 illustrates a piece of hosiery being fitted on a leg, as seen from the side, and FIG. 9 illustrates the knee being elevated so the roller support may be removed, as seen from the side.

DETAILED DESCRIPTION

Figure 1:
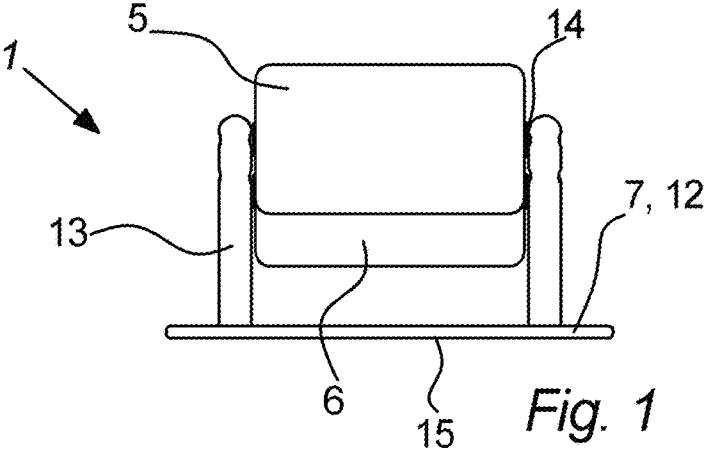
FIG. 1 illustrates a roller support, as seen from the back.
Figure 2:
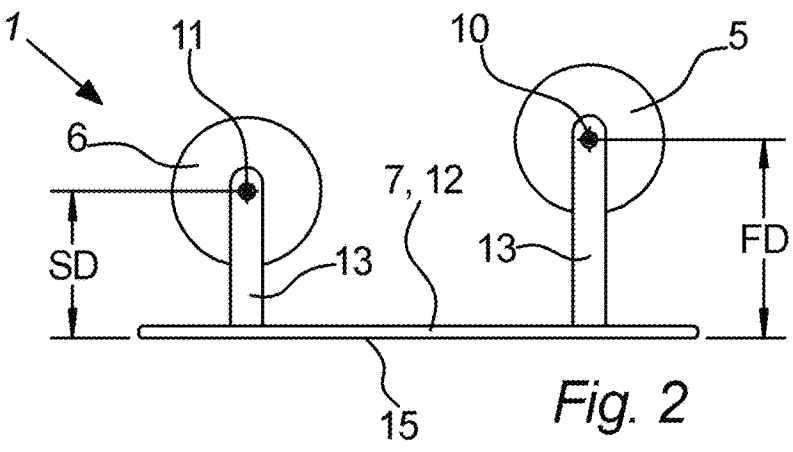
FIG. 2 illustrates a roller support, as seen from the side.
Figure 3:
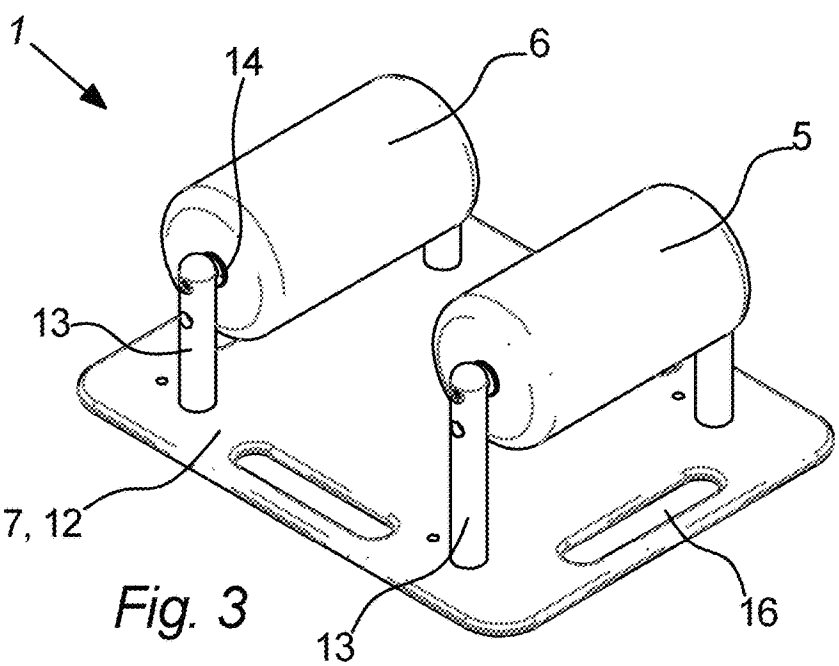
FIG. 3 illustrates a roller support, as seen in an isometric view.
Figure 4:
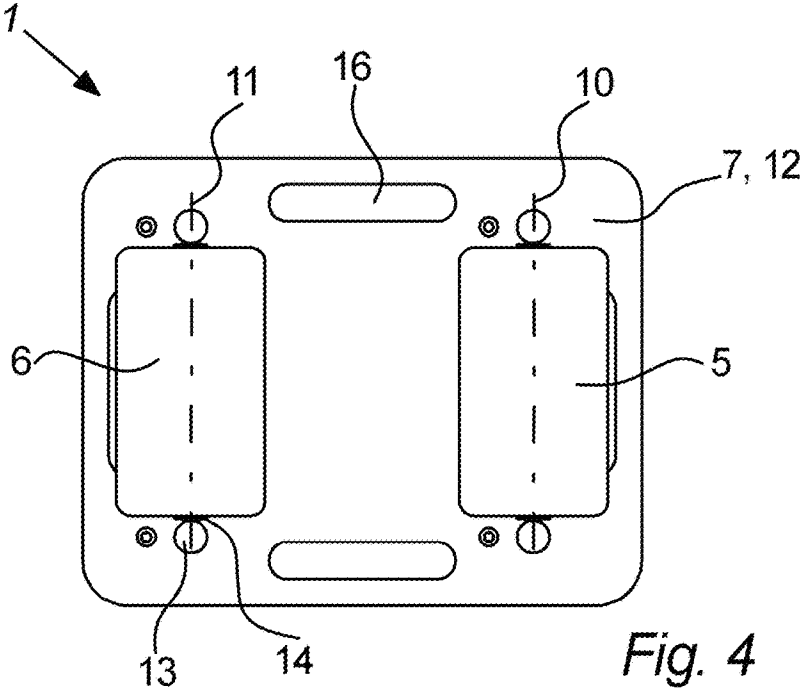
FIG. 4 illustrates a roller support, as seen from the top.

FIG. 1 illustrates a roller support 1, as seen from the back, FIG. 2 illustrates a roller support 1, as seen from the side, FIG. 3 illustrates a roller support 1, as seen in an isometric view and FIG. 4 illustrates a roller support 1, as seen from the top.

In this embodiment the roller support 1 comprises a first free-rolling roller 5 and a second free-rolling roller 6 being held in a fixed mutual distance by means of a base 7 comprising a support face 15 on which the roller support 1 rests when placed on an underlying surface 2 (see FIGS. 5-9). However, in another embodiment the roller support 1 could comprise more than two rollers 5, 6—such as three, four, six or even more—e.g., depending on the specific use, the size of the rollers or other.

In this embodiment the base 7 comprises a substantially flat base plate 12 from which roller pillars 13 protrude, wherein a roller shaft 14 is extending through the centre of the rollers 5, 6 and wherein the roller shaft 14 are connected to and suspended by the roller pillars 13. However, in another embodiment the base 7 could be formed as a plate with bends forming protrusions to which the rollers 5, 6 could be attached, the base 7 could be formed by bend pipes or rods or the base 7 could be formed in numerous other ways known to the skilled person.

In this embodiment the underside of the flat base plate 12 forms a support face 15 of the base 7 but depending on the design of the base 7, the support face 15 could be form in numerous different ways by the areas of the base 7 lying against the underlying surface when the roller support 1 is in use with the rollers 5, 6 extending upwards in a direction away from the support face 15.

In this embodiment the rollers 5, 6 are free-rolling around the roller shafts 14 but in another embodiment the roller shafts 14 could be free-rolling in the roller pillars 13 or the rollers 5, 6 would not comprises a throughgoing roller shaft 14 and instead studs at the ends of the rollers 5, 6 would be free-rolling in relation to the roller pillars 13 or the rollers 5, 6 could be formed free-rolling in numerous other ways known to the skilled person. In another embodiment the free-rolling ability could be ensures through journal bearings, ball bearings, roller bearings or other located between the roller shafts 14 and the base 7, between the rollers 5, 6 and the roller shafts 14 or elsewhere.

In this embodiment the base plate 12 and the roller pillars 13 are formed in a plastic material and are attached to each other and to the roller shafts 14 by means of screws. However, in another embodiment the at least some of the base parts 12, 13, 14 could also or instead be made from another material such as wood, a metal such as stainless steel or aluminium, a composite material or other.

In this embodiment the rollers 5, 6 are substantially identical and each formed by a polyurethane foam material with a coating of a plastic material to make the rollers 5, 6 soft, easy to clean and durable. However, in another embodiment the two rollers 5, 6 could be different in size, design, or material and/or the rollers 5, 6 could be made from another material such as textile, wool, plastic, metal, another foam material or other or any combination thereof.

In this embodiment the outer dimensions of the base plate 12 is 300×375 mm to both ensure that the roller support 1 is not tipping or tilting during use, while at the same time ensuring that the base plate 12 can easily be fitted in under one leg without colliding with the other leg. Furthermore, in this embodiment the rollers 5, 6 are Ø100 and around 180 mm long and spaced around 230 mm apart so in this embodiment the rollers 5, 6 are arranged within the outer periphery of the base plate 12—as seen best in FIG. 4—to make the roller support 1 stable when supporting a leg 4 (see FIGS. 5-9). However, the support area of the base 7—in this case the support face 15 of the base plate 12—could in another embodiment be formed smaller to form a lighter and more compact roller support 1 or the support area of the base 7 could in another embodiment be formed longer and/or wider to form a more stable roller support 1. Furthermore, in another embodiment one or more of the rollers 5, 6 could be provided with a bigger diameter to reduce pressure between the roller 5, 6 and the leg or the diameter of one or more of the rollers 5, 6 could be smaller to form a lighter and more compact roller support 1. Likewise in another embodiment the distance between the first rotation axis 10 of the first free-rolling roller 5 and the second rotation axis 11 of the second free-rolling roller 6 could be bigger to ensure less pressure against the second free-rolling roller 6 or it could be smaller to form a lighter and more compact roller support 1. Also, in another embodiment one or more of the rollers 5, 6 could be formed with varying diameter e.g., smaller at the middle to centre the leg at the middle of the roller 5, 6.

In another embodiment the free-rolling rollers 5, 6 may be replaceable so that a roller with larger or smaller diameter may be mounted on the base 7 or they may easily be removed for cleaning or replaced due to wear.

In this embodiment the first rotation axis 10 of the first free-rolling roller 5 is arranged at a first roller distance FD of around 130 mm from the support face 15 of the base 7 and the second rotation axis 11 of the second free-rolling roller 6 is arranged at a second roller distance SD of around 95 mm from the support face 15 of the base 7 making the first roller distance FD is around 30% bigger than the second roller distance SD. However, in another embodiment one or more of the rollers 5, 6 could be arranged closer to the support face 15 or further away from the support face 15—e.g. to alter the angle of the leg 4 when resting on the roller support 1, to make the roller support lighter and more compact or for another reason.

In this embodiment the first roller distance FD and the second roller distance SD are fixed but in another embodiment one or both could be formed adjustable so that the roller support 1 could be adjusted to be used for different persons with different body types, to increase comfort of the user or increase functionality.

In this embodiment the base 7 is provided with handles 16 in the form of openings formed in the base plate 12 along the edges of the base plate 12 to ease insertion and removal and general handling of the roller support 1. However, in another embodiment the base plate 12 could comprise another number of handles 16 which also or instead would be located differently on the base 7 and/or the handles 16 could be formed as separate parts connected to the base 7 and/or the roller support 1 would comprise no handles 16.

FIG. 5 illustrates a simplified representation of the lower part of a person laying on an underlying surface 2, as seen from the side.

In the embodiments shown in FIGS. 5-9 only the legs 4 of the person onto which the hosiery 8 need to be dressed is shown and in this embodiment the underlying surface 2 on which said person is placed in a supine position is a bed. However, in another embodiment the person could be laying on the back on a table, on the floor, on a sofa or other.

In this embodiment the leg 4 is naked but in another embodiment only the lower leg would be naked and/or the hosiery is dressed on top of another garment.

FIG. 6 illustrates a roller support 1 being placed under a leg 4, as seen from the side.

In this embodiment the knee 3 of the leg 4 of said person placed on the underlying surface in a supine position is elevated either by said person or by a helping person while the knee 3 is bend in a knee angle KA of approximately 90° and while the foot 17 of said person is moved across and resting against the underlying surface 2. However, in another embodiment the knee 3 could be bend in another knee angle KA—such as 850, 650, 45° or even less or 100°, 110° or even more. Or in another embodiment the knee 3 would not be bend at all and the knee 3 would be elevated along with the entire leg 4 by only bending at the hip. In this case the foot 17 is resting on the underlying surface 2, so in this case the leg 4 will remain in the bend position unaided and the helper is therefore free to get the roller support 1 and place it under the elevated knee 3 so that the first free-rolling roller 5 of the roller support 1 is placed substantially under the elevated knee 3, so that the second free-rolling roller 6 is placed substantially under the calf 9 of the leg 4 and so that the support face 15 of the base 7 of the roller support 1 is resting on the underlying surface 2.

FIG. 7 illustrates a leg 4 resting on a roller support 1, as seen from the side.

With the roller support 1 in place under the bend leg 1, the helper is now free to lower the knee 3 of the leg 4 by lifting the foot 17 of the underlying surface 2 and stretching the leg 4 until the leg 4 rests on the first free-rolling roller 5 and the second free-rolling roller 6. Depending on the design of the roller support 1 and the nature of the leg 4 additional positioning of the roller support 1 takes place during lowering of the knee 3 by the back of the thigh 18 pushing against the first free-rolling roller 5 and pushes the roller support 1 a little forward towards the foot 17, so that the first free-rolling roller 5 is positioned in the back of the knee 3. Alternatively, the helper may need to push or pull the roller support 1 a little in the lengthwise direction of the leg 4 so that the first free-rolling roller 5 is positioned in the back of the knee 3—or the roller support 1 is left in its initial position.

In another embodiment the person to which the leg 4 belongs could lower the knee 3 by stretching the leg 4 and lowering it.

The knee 3 is in this embodiment lowered until the first free-rolling roller 5 is supporting the leg 4 in the back of the knee 3 and the second free-rolling roller 6 is supporting the calf 9 of the leg 4. By designing the roller support 1 so that the first free-rolling roller 5 is higher than the second free-rolling roller 6 and the two spaced apart by a suitable distance—which in this case is 230 mm—the leg 4 is now supported in a comfortable position by the roller support 1 in which substantially the entire leg—and at least all parts of the leg 4 from the middle of the thigh 18 and downwards—is lifted of the underlying surface 2 so that a free space is formed between the underlying surface 2 and at least the entire lower leg 4.

FIG. 8 illustrates a piece of hosiery 8 being fitted on a leg 4, as seen from the side.

The person laying down or a person helping said person may now dress the hosiery 8 onto the leg 4 resting on the roller support 1. Due to the free-rolling rollers 5, 6 it is possible to simply position the hosiery opening onto the foot 17 and the lower part of the leg 4 and slide the hosiery 8 onto the leg 4. Since the rollers 5, 6 are free rolling, it is possible to slide the hosiery 8 onto the leg 4 without lifting the leg 4 to overcome any friction. Thereby, the helping person do not have to lift the leg 4 of the person with reduced mobility and simultaneously pull the hosiery onto the leg, whereby the strain on the back of the helping person is greatly reduced.

In this embodiment the hosiery 8 is a compression stocking dressed onto the lower part of the leg 4 by means first rolling the stocking onto a flexible rubber sleeve (not shown) which in turn is rolled onto the foot 17 and further up the leg 4 while unrolling the compression stocking—the so called Doff N' Donner system. While rolling the compression stocking onto the leg 4 the roll—comprising the stocking and the sleeve—may easily pass the free-rolling rollers 5, 6 by sliding or rolling between the leg 4 and the free-rolling roller 5, 6. However, in another embodiment the hosiery 8 could be ordinary stockings, socks, leg warmer, trousers or other dressed by unrolling, pushing and/or pulling.

FIG. 9 illustrates the knee 3 being elevated so the roller support 1 may be removed, as seen from the side.

Once the hosiery 8 is dressed onto the leg 4, the knee 3 of the leg 4 is again elevated so that the leg 4 is no longer resting on the roller support 1 and in this embodiment so that the leg 4 is held in the elevated position by the foot 17 of the leg resting on the underlying surface 2. The roller support 1 can now easily be removed, and the leg 4 can be stretched and placed in the position indicated in FIG. 5. The roller support 1 can now be used for dressing hosiery 8 on the other leg or for dressing hosiery 8 on another person.

The invention has been exemplified above with reference to specific examples of free-rolling rollers 5, 6, hosiery 8, bases 7 and other. However, it should be understood that the invention is not limited to the particular examples described above but may be designed and altered in a multitude of varieties within the scope of the invention as specified in the claims.

LIST

1. Roller support
2. Underlying surface
3. Knee
4. Leg
5. First free-rolling roller
6. Second free-rolling roller
7. Base
8. Hosiery
9. Calf
10. First rotation axis
11. Second rotation axis
12. Base plate
13. Roller pillar
14. Roller shaft
15. Support face
16. Handle
17. Foot
18. Thigh
KA. Knee angle
FD. First roller distance
SD. Second roller distance

The invention claimed is:

1. A method for dressing hosiery on a person with reduced mobility, said method comprises the comprising steps of:

placing said person with reduced mobility in a supine position on an underlying surface, elevating a knee of a leg of said person, sliding a roller support in under said elevated knee so that a first free-rolling roller of said roller support is placed substantially under said elevated knee and so that a second free-rolling roller of said roller support is placed substantially under a calf of said leg, wherein said first free-rolling roller and said second free-rolling roller are interconnected through a base of said roller support, wherein said base comprises a support face resting on said underlying surface, lowering said knee until said leg rests on said first free-rolling roller and said second free-rolling roller, and sliding or rolling said hosiery onto said leg so that at least a part of said hosiery slides or rolls between said leg and at least said second free-rolling roller.

2. The method according to claim 1, wherein said method further comprises a step of elevating said knee again after sliding or rolling said hosiery onto said leg and removing said roller support.

3. The method according to claim 1, wherein said knee of said leg of said person is elevated until a knee angle (KA) between a thigh and a lower leg of said leg is at least 60°.

4. The method according to claim 1, wherein said knee is lowered until said knee rests on said first free-rolling roller and said calf rests on said second free-rolling roller.

5. The method according to claim 1, wherein said first free-rolling roller rotates around a first rotation axis and said second free-rolling roller rotates around a second rotation axis, and wherein said method further comprises sliding said roller support in under said elevated knee so that said first rotation axis and said second rotation axis are transverse in relation to a longitudinal direction of said leg.

6. The method according to claim 1, wherein said method further comprises forming said roller support so that said support face is substantially flat and extending past both said first free-rolling roller and said second free-rolling roller before sliding said roller support in under said elevated knee.

7. The method according to claim 1, wherein said first free-rolling roller rotates around a first rotation axis and said second free-rolling roller rotates around a second rotation axis, and wherein said method further comprises forming said roller support so that said first rotation axis is extending further from said support face than said second rotation axis.

8. The method according to claim 1, wherein said hosiery is a compression stocking.

9. The method according to claim 1, wherein said method further comprises forming said roller support so that said first free-rolling roller rotates around a first rotation axis and said second free-rolling roller rotates around a second rotation axis, wherein said first rotation axis is arranged at a first roller distance (FD) of between 30 and 300 mm from said support face, and wherein said second rotation axis is arranged in a second roller distance (SD) between 5 and 60% closer to said support face than said first rotation axis.

10. The method according to claim 1, wherein said method further comprises forming said roller support so that at least one of said first or said second free-rolling roller is padded.

11. The method according to claim 1, wherein said method further comprises forming said roller support so that said first free-rolling roller and said second free-rolling roller are substantially parallel, and so that an axis of said first free-rolling roller and an axis of said second free-rolling roller is are oriented, respectively, to be substantially perpendicular to a direction in which said parallel first free-rolling roller and said second free-rolling roller are displaced from each other.

12. The method according to claim 1, wherein said method further comprises forming said roller support so that said first free-rolling roller rotates around a first rotation axis and said second free-rolling roller rotates around a second rotation axis, and wherein said first rotation axis and said second rotation axis are displaced between 50 and 500 mm.

13. The method according to claim 1, wherein said method further comprises forming said roller support so that said first free-rolling roller and said second free-rolling roller are substantially identical.

* * * * *